US005355682A

United States Patent [19]

Agrawal et al.

[11] Patent Number: 5,355,682

[45] Date of Patent: Oct. 18, 1994

[54] CRYOGENIC AIR SEPARATION PROCESS PRODUCING ELEVATED PRESSURE NITROGEN BY PUMPED LIQUID NITROGEN

[75] Inventors: Rakesh Agrawal, Emmaus; Bruce K. Dawson, Bethlehem; Jeffrey A. Hopkins, Whitehall; Jianguo Xu, Fogelsville, all of Pa.

[73] Assignee: Air Products and Chemicals, Inc., Allentown, Pa.

[21] Appl. No.: 123,026

[22] Filed: Sep. 15, 1993

[51] Int. Cl.[5] ..... F25J 3/00

[52] U.S. Cl. ..... 62/41; 62/25; 62/38

[58] Field of Search ..... 62/25, 38, 41

[56] References Cited

U.S. PATENT DOCUMENTS

| | | | |
|---|---|---|---|
| 3,426,543 | 2/1969 | Becker | 62/41 |
| 4,006,001 | 2/1977 | Schonplug | 62/29 |
| 4,717,410 | 1/1988 | Grenier | 62/39 |
| 5,098,457 | 3/1992 | Cheung | 62/24 |
| 5,148,680 | 9/1992 | Dray | 62/24 |
| 5,303,556 | 4/1994 | Dray et al. | 62/41 |

*Primary Examiner*—Ronald C. Capossela

*Attorney, Agent, or Firm*—Willard Jones, II; William F. Marsh; James C. Simmons

[57] ABSTRACT

The process of the present invention is a cryogenic air separation process with three important features: (1) at least a portion of a nitrogen-rich liquid from the column system is boosted in pressure before being vaporized and delivered as a product; (2) at least a portion of the feed air is at least partially condensed in indirect heat exchange with the boosted pressure, nitrogen-rich stream; and (3) a portion of the liquid nitrogen condensed from the vapor nitrogen from the top of the higher pressure column is returned to the higher pressure column as reflux with the remaining portion being removed from the column system.

15 Claims, 3 Drawing Sheets

CRYOGENIC AIR SEPARATION PROCESS PRODUCING ELEVATED PRESSURE NITROGEN BY PUMPED LIQUID NITROGEN

TECHNICAL FIELD OF THE INVENTION

The process of the present invention relates to a process for the production of pressurized oxygen and nitrogen products by the cryogenic distillation of air.

BACKGROUND OF THE INVENTION

There are numerous situations for which both pressurized oxygen and pressurized nitrogen are required. Since equipment cost and power cost are the important aspects of the cost of production, an objective of the present invention is to reduce the equipment or power cost, or both, for a process to produce both pressurized oxygen and nitrogen products.

U.S. Pat. No. 5,148,680 discloses a pumped liquid oxygen (LOX), pumped liquid nitrogen (LIN) process which produces both oxygen and nitrogen products at elevated pressure directly from the cold box by first boosting the pressure of liquid oxygen and liquid nitrogen to higher pressures and warming them by heat exchange with a portion of the feed air thereby at least partially condensing the portion. A portion of the condensed nitrogen from the top of the high pressure column is fed to the low pressure column as reflux.

SUMMARY OF THE INVENTION

The present invention relates to a process for the separation of a compressed feed air stream to produce elevated pressure oxygen and nitrogen gases comprising: (a) using a double column system with a lower pressure column and a higher pressure column; (b) feeding at least a portion of the compressed and cooled feed air to the higher pressure column; (c) separating the portion of the feed air from step (b) into a nitrogen vapor and an oxygen-enriched liquid in the higher pressure column; (d) feeding the oxygen-enriched liquid from the bottom of the higher pressure column to an intermediate point in the lower pressure column; (e) condensing at least a portion of a nitrogen-rich vapor from the higher pressure column thereby producing a liquid nitrogen stream; returning a portion of the liquid nitrogen stream to the top of the higher pressure column; and removing the remaining portion of the liquid nitrogen from the double column system; (f) increasing the pressure of a nitrogen-rich liquid which is removed from the double column system; (g) cooling and at least partially condensing a portion of the feed air by indirect heat exchange with the elevated pressure nitrogen-rich stream of step (f); and (h) removing an oxygen stream and a vapor stream containing at least 80% nitrogen from the lower pressure column.

The present invention also relates to the process described above wherein the oxygen stream of step (h) is a liquid and the pressure of the liquid oxygen stream is boosted to a higher pressure and vaporized by indirect heat exchange with a second portion of feed air thereby at least partially condensing that portion of feed air.

DETAILED DESCRIPTION OF THE INVENTION

The process of the present invention has three important features: (1) at least a portion of a nitrogen-rich liquid from the column system is boosted in pressure before being vaporized and delivered as a product; (2) at least a portion of the feed air is at least partially condensed in indirect heat exchange with the boosted pressure, nitrogen-rich stream; and (3) a portion of the liquid nitrogen condensed from the vapor nitrogen from the top of the higher pressure column is returned to the higher pressure column as reflux with the remaining portion being removed from the column system.

In the preferred mode, the other portion of liquid nitrogen leaving the column system in step (3) is the nitrogen-rich liquid in step (1). When the nitrogen-rich liquid in step (1), is withdrawn from a different location of the column system, the flow of the other portion of liquid nitrogen in step (3) can be zero.

In the most preferred mode, a portion of liquid oxygen from the column system is pumped to an elevated pressure and is also vaporized by heat exchange with a portion of the feed air stream which is at least partially condensed. This will coproduce an elevated pressure oxygen product stream.

The process of the present invention can be best understood with reference to several specific embodiments thereof.

Figure 1:
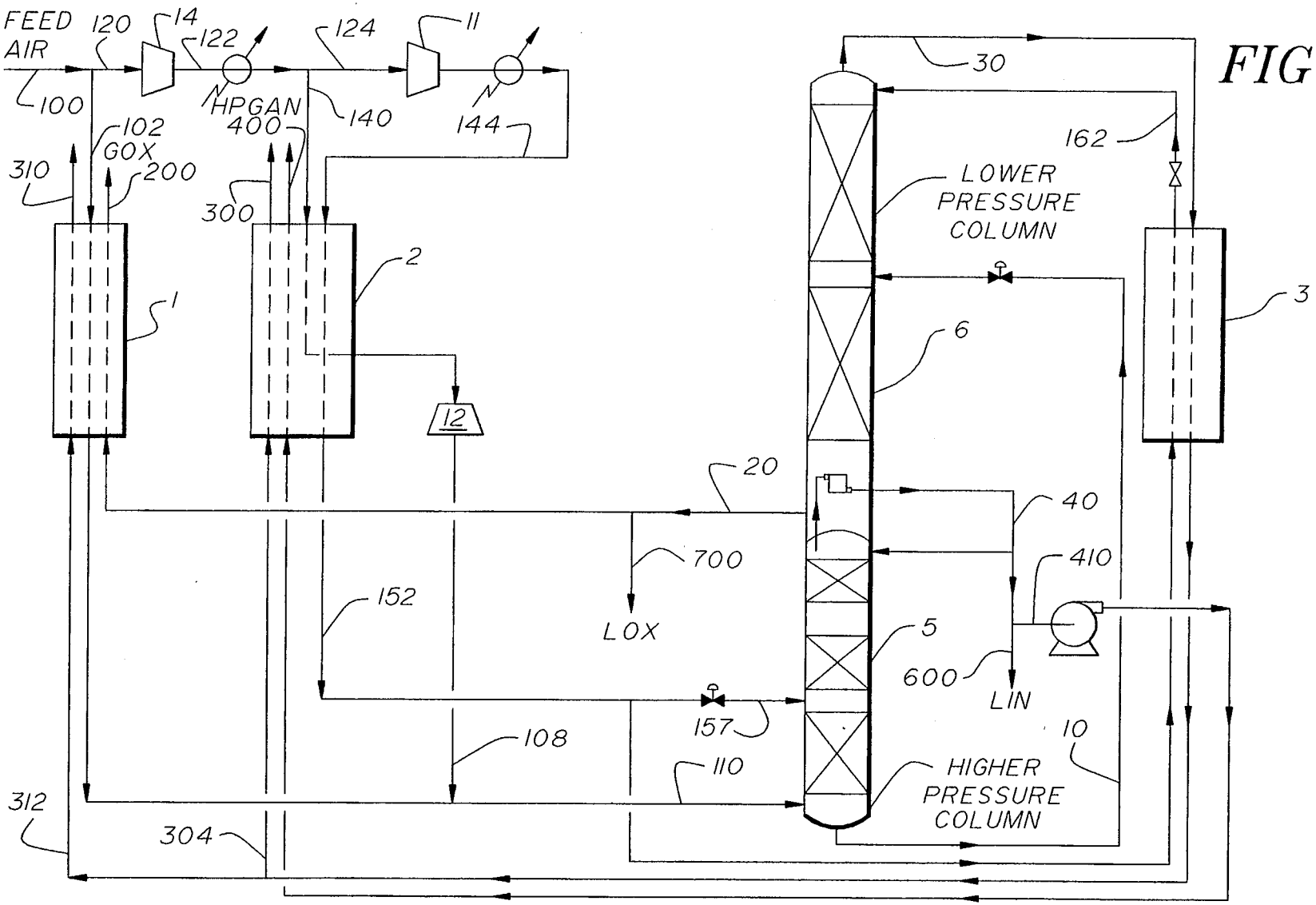
FIGS. 1 through 3 are schematic diagrams of three embodiments of the process of the present invention.

FIG. 1 shows one embodiment of the present invention. With reference to FIG. 1, feed air, line 100, which is compressed and free of contaminants, is first split into two substreams, lines 102 and 120. The first substream, line 102, is cooled in heat exchanger 1 to a cryogenic temperature and mixed with the expander effluent, line 108, to form the higher pressure column feed, line 110, which is then fed to higher pressure column 5. The other substream, line 120, is further boosted in pressure by compressor 14, cooled and then further split into two parts, lines 140 and 124. The first part, line 140, is cooled in heat exchanger 2 to an intermediate temperature and then expanded in expander 12. The expander effluent, line 108, is mixed with the first portion of cooled air, line 106, to form the higher pressure column feed, line 110. The second part, line 124, is yet further compressed by compressor 11 which is mechanically linked to expander 12. The further compressed second part is then aftercooled, further cooled in heat exchanger 2, to a temperature below −220° F., preferably below −250° F. (thus, becoming a dense fluid) and split into two portions, lines 157 and 158. The first portion of this dense fluid, line 157, can be fed to higher pressure column 5 at an intermediate location. The remaining portion, line 158, is further subcooled in subcooler 3. This subcooled portion, line 162, is then fed to the top of lower pressure column 6 as reflux.

The feeds to higher pressure column 5, lines 110 and 157, is distilled and separated into a nitrogen vapor stream and oxygen-enrich bottoms liquid. The vapor nitrogen is condensed in a reboiler/condenser located in the bottom of lower pressure column 6. A portion of this liquid nitrogen is returned to higher pressure column 5 as reflux. The remaining portion, line 40, is split into the product liquid nitrogen, line 600, and the liquid nitrogen to be boosted in pressure, line 410. The liquid nitrogen to be boosted in pressure, line 410, is then pumped to a higher pressure by pump 13 and heated and vaporized in heat exchanger 2 resulting in an elevated pressure and close to ambient temperature gaseous nitrogen product, line 400.

The oxygen-enriched bottoms liquid from higher pressure column 5, line 10, is fed into lower pressure column 6 at an intermediate position. This stream and the liquid air fed to the top of lower pressure column 6, line 162, are distilled in lower pressure column 6 and separated into a liquid oxygen bottoms and a nitrogen-rich overhead containing at least 80% nitrogen. A portion of the liquid oxygen bottoms, line 20, is removed from the bottom of lower pressure column 6 and then split into a liquid oxygen product, line 700, and a portion that is vaporized and heated up to a temperature close to ambient in heat exchanger 1 and removed as gaseous oxygen product, line 200. The nitrogen-rich overhead is removed from the top of lower pressure column 6, line 30, is heated in subcooler 3 and split into two portions, lines 304 and 312. These two streams are then heated up in heat exchangers I and 2, respectively, to ambient temperatures before being vented or used for air cleaning adsorption bed regeneration.

Figure 2:
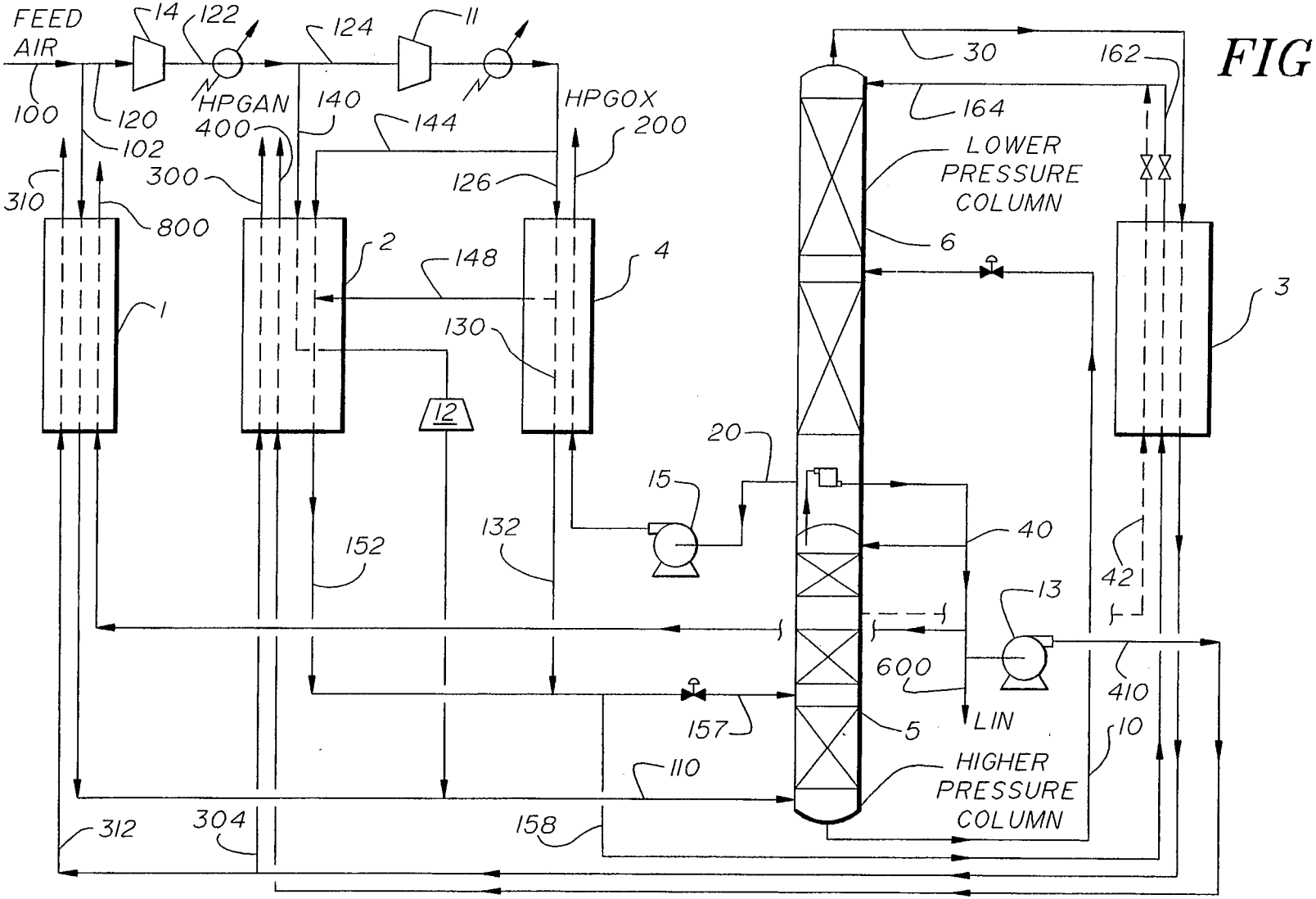

The embodiment shown in FIG. 2 is similar to the one shown in FIG. 1. The differences are described below. First, the second compressed feed air substream, line 124, is still further compressed and then split into two subparts, lines 144 and 126. The first subpart, line 126, is cooled in indirect heat exchange with the warming oxygen stream in heat exchanger 4, further split into two streams, lines 130 and 148, at an intermediate point of heat exchanger 4. The first stream, line 130, is further cooled to a temperature below the critical temperature of air by indirect heat exchange with the warming oxygen in heat exchanger 4. The other subpart, line 144, is cooled in heat exchanger 2, combined with the stream, line 148, from heat exchanger 4 at an intermediate temperature and further cooled to a temperature below −220° F., preferably below −250° F. The higher pressure air streams that are cooled below −220° F., lines 152 and 132, are then combined. Second, the liquid oxygen, line 20, from lower pressure column 6, is pumped to a higher pressure by pump 15 and then vaporized and heated to ambient temperature in heat exchanger 4. Finally, as an option, an impure liquid nitrogen stream, line 42, is withdrawn from an intermediate location of the higher pressure column, subcooled in the cold section of subcooler 3 and fed along with the liquid air, line 158, to the top of lower pressure column 6.

Figure 3:
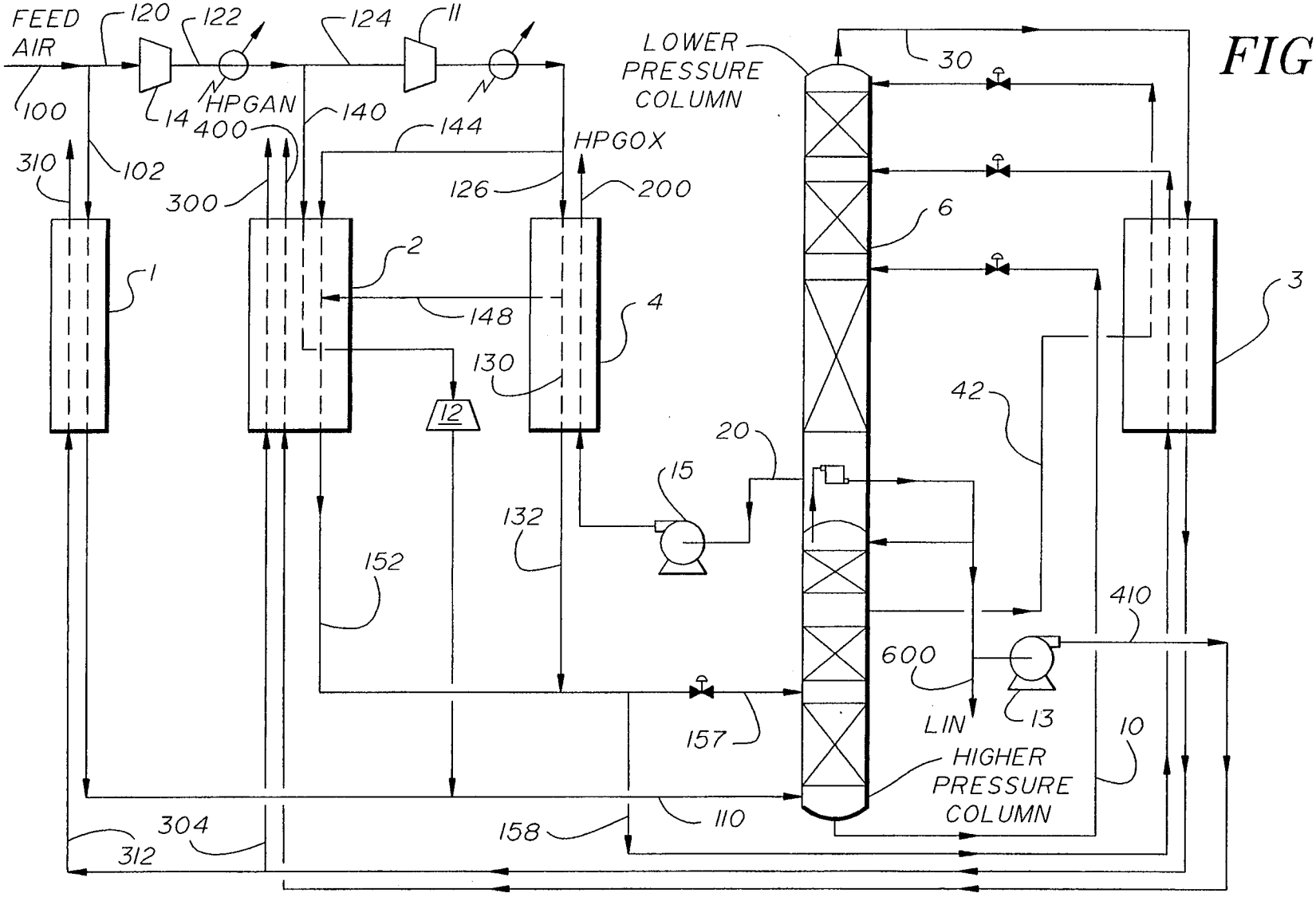

FIG. 3 is another embodiment of the present invention. The difference between the embodiment of FIG. 3 and the embodiment of FIG. 2 is that the impure liquid nitrogen stream, line 42, withdrawn from an intermediate location of higher pressure column 6 is subcooled in the cold section of subcooler 3 and fed to the top of lower pressure column 6, however, the liquid air, line 158, is fed to an intermediate location in lower pressure column 6. The remainder of the embodiment is the same as in FIG. 2.

As is evident from the above description, the present invention differs from the process taught in U.S. Pat. No. 5,148,680 (the background art process) in that the background art process has a liquid nitrogen stream condensed from the vapor nitrogen from the top of the higher pressure column going to the lower pressure column as reflux, while in the present invention the liquid nitrogen condensed from the vapor nitrogen from the top of the higher pressure column is partly returned to the higher pressure column as reflux, partly taken out of the distillation column system. In the present invention, no portion of this liquid nitrogen is fed into the lower pressure column as reflux.

Obviously, the present invention has the advantage in terms of low compression machinery cost as does that of U.S. Pat. No. 5,148,680, however, when the embodiments in FIGS. 1 and 2 are used, the present invention cycle eliminates the top section of the lower pressure column, which can be translated into further capital savings. Further, when the embodiment of FIG. 3 is used, the process will allow optimum recoveries of oxygen and nitrogen by optimizing the tray on which the impure reflux to the lower pressure column is withdrawn. The optimized recovery can be translated into savings in capital or power or both. Results of a simulation using the embodiment of FIG. 2 are summarized in the following Table. The purities of products oxygen (stream 200) and nitrogen (streams 400 and 600) are 98% $O_2$ and 6 vppm $O_2$, respectively.

| Stream Number | 100 | 122 | 140 | 152 | 158 | 200 | 300 |
|---|---|---|---|---|---|---|---|
| Temperature: °F. | 104.0 | 104.0 | 104.0 | −276.9 | −267.9 | 73.8 | 88.8 |
| Pressure: psia | 85.5 | 750 | 750 | 1,150 | 1028.3 | 1,450 | 16.2 |
| Flow: lbmol/hr | 100.0 | 73.0 | 33.3 | 31.0 | 31.0 | 17.3 | 33.7 |
| **Stream Number** | **310** | **400** | **20** | **40** | **600** | **42** | **800** |
| Temperature: °F. | 83.8 | 88.8 | −291.0 | −288.2 | −288.2 | −288.2 | 83.8 |
| Pressure: psia | 15 | 1,133.5 | 21.2 | 79.7 | 79.7 | 79.7 | 85.5 |
| Flow: lbmol/hr | 23.7 | 20.3 | 17.3 | 27.0 | .1 | 1.8 | 4.9 |

An unexpected benefit of the present invention, particularly when a fraction of the partially condensed feed air portion is fed to the top of the lower pressure column as impure reflux and where product pressures are high, is that the lower oxygen recovery resulting from having no nitrogen reflux in the lower pressure column does not result in an overall energy penalty or a capital penalty. The process of the present invention is particularly advantageous when both oxygen and nitrogen are required at very high pressures.

The present invention has been described with reference to several specific embodiments thereof. These embodiments should not be seen as a limitation on the present invention. The scope of the present invention should be ascertained from the following claims.

We claim:

1. A process for the separation of a compressed feed air stream to produce elevated pressure oxygen and nitrogen gases comprising:

(a) using a double column system with a lower pressure column and a higher pressure column;

(b) feeding at least a portion of the compressed and cooled feed air to the higher pressure column;

(c) separating the portion of the feed air from step (b) into a nitrogen vapor and an oxygen-enriched liquid in the higher pressure column;

(d) feeding the oxygen-enriched liquid from the bottom of the higher pressure column to an intermediate point in the lower pressure column;

(e) condensing at least a portion of a nitrogen-rich vapor from the higher pressure column thereby producing a liquid nitrogen stream; returning a portion of the liquid nitrogen stream to the top of the higher pressure column; and removing the remaining portion of the liquid nitrogen from the double column system;

(f) increasing the pressure of a nitrogen-rich liquid which is removed from a location of the double column system;

(g) cooling and at least partially condensing a portion of the feed air by indirect heat exchange with the elevated pressure nitrogen-rich stream of step (f);

(h) removing an oxygen stream and a vapor stream containing at least 80% nitrogen from the lower pressure column.

2. The process of claim 1 wherein the oxygen stream of step (h) is a liquid and the pressure of the liquid oxygen stream is boosted to a higher pressure and vaporized by indirect heat exchange with a second portion of feed air thereby at least partially condensing that portion of feed air.

3. The process of claim 2 wherein the at least partially condensed feed air portions are fed to the column system.

4. The process of claim 3 wherein at least a fraction of the at least partially condensed feed air portions is fed to the top of the lower pressure column.

5. The process of claim 3 wherein at least a fraction of the at least partially condensed feed air portions is fed to an intermediate location of the lower pressure column and wherein an impure liquid nitrogen stream is withdrawn from an intermediate location of the higher pressure column and fed to the top of the lower pressure column as reflux.

6. The process of claim 3 wherein a high pressure air stream is expanded from a higher pressure to a lower pressure through isentropic expansion.

7. The process of claim 6 wherein the expander for isentropic expansion of the high pressure air stream is coupled to a compressor.

8. The process of claim 7 wherein the compressor coupled with the expander is used to compress an air stream with a pressure higher than that of the higher pressure column.

9. The process of claim 6 wherein the expander for isentropic expansion of the high pressure air stream is coupled with an electric generator.

10. The process of claim 2 wherein the feed air that is at least partially condensed is compressed to a pressure higher than 600 psia before being cooled to a temperature below −220° F.

11. The process of claim 10 wherein the at least partially condensed air is a dense fluid.

12. The process of claim 2 wherein a gaseous oxygen stream is produced directly from the bottom of the lower pressure column.

13. The process of claim 2 wherein a nitrogen rich gas stream is produced directly from the higher pressure column.

14. The process of claim 2 wherein the nitrogen-rich liquid of step (f) is taken from an intermediate position of the higher pressure column.

15. The process of claim 2 wherein the nitrogen-rich liquid from the column system of step (f) is a portion of liquid nitrogen removed from the column system in step (e).

* * * * *